US010334345B2

(12) United States Patent
Perianu et al.

(10) Patent No.: US 10,334,345 B2
(45) Date of Patent: Jun. 25, 2019

(54) NOTIFICATION AND ACTIVATION SYSTEM UTILIZING ONBOARD SENSORS OF WIRELESS EARPIECES

(71) Applicant: BRAGI GmbH, München (DE)

(72) Inventors: Vlad Perianu, München (DE); Peter Vincent Boesen, München (DE)

(73) Assignee: BRAGI GmbH, München (DE)

( * ) Notice: Subject to any disclaimer, the term of this patent is extended or adjusted under 35 U.S.C. 154(b) by 5 days.

(21) Appl. No.: 15/391,454

(22) Filed: Dec. 27, 2016

(65) Prior Publication Data

US 2017/0188127 A1 Jun. 29, 2017

Related U.S. Application Data

(60) Provisional application No. 62/272,348, filed on Dec. 29, 2015.

(51) Int. Cl.
*H04R 1/10* (2006.01)
*G10L 25/48* (2013.01)

(52) U.S. Cl.
CPC ..... *H04R 1/1016* (2013.01); *H04R 1/1041* (2013.01); *G10L 25/48* (2013.01); *H04R 1/1091* (2013.01); *H04R 2420/07* (2013.01); *H04R 2460/03* (2013.01); *H04R 2460/07* (2013.01)

(58) Field of Classification Search
CPC ... G10L 25/48; H04R 2460/07; H04R 1/1016; H04R 1/1041; H04R 1/1091; A61B 5/02427; A61B 5/02438; A61B 5/0255; A61B 5/03; A61B 5/6817; A61B 5/721; G06F 3/14; G06F 3/011
See application file for complete search history.

(56) References Cited

U.S. PATENT DOCUMENTS

| | | | |
|---|---|---|---|
| 3,934,100 | A | 1/1976 | Harada |
| 4,150,262 | A | 4/1979 | Ono |
| 4,334,315 | A | 6/1982 | Ono et al. |
| 4,375,016 | A | 2/1983 | Harada |
| 4,588,867 | A | 5/1986 | Konomi |
| 4,654,883 | A | 3/1987 | Iwata |
| 4,682,180 | A | 7/1987 | Gans |
| 4,791,673 | A | 12/1988 | Schreiber |
| 4,865,044 | A | 9/1989 | Wallace et al. |

(Continued)

FOREIGN PATENT DOCUMENTS

| | | | |
|---|---|---|---|
| EP | 1017252 | A2 | 7/2000 |
| EP | 2903186 | A1 | 8/2015 |

(Continued)

OTHER PUBLICATIONS

Announcing the $3,333,333 Stretch Goal (Feb. 24, 2014).

(Continued)

*Primary Examiner* — Fan S Tsang
*Assistant Examiner* — Angelica M McKinney
(74) *Attorney, Agent, or Firm* — Goodhue, Coleman & Owens, P.C

(57) ABSTRACT

A system, method and one or more wireless earpieces for determining a status of a user. Sensor readings for the user are performed utilizing sensors of the one or more wireless earpieces. The sensor readings are analyzed. A status of the user is determined utilizing the sensor readings from the sensors of the one or more wireless earpieces.

20 Claims, 4 Drawing Sheets

(56) References Cited

U.S. PATENT DOCUMENTS

| | | | |
|---|---|---|---|
| 5,191,602 | A | 3/1993 | Regen et al. |
| 5,201,007 | A | 4/1993 | Ward et al. |
| 5,280,524 | A | 1/1994 | Norris |
| 5,295,193 | A | 3/1994 | Ono |
| 5,298,692 | A | 3/1994 | Ikeda et al. |
| 5,343,532 | A | 8/1994 | Shugart |
| 5,363,444 | A | 11/1994 | Norris |
| 5,497,339 | A | 3/1996 | Bernard |
| 5,606,621 | A | 2/1997 | Reiter et al. |
| 5,613,222 | A | 3/1997 | Guenther |
| 5,692,059 | A | 11/1997 | Kruger |
| 5,721,783 | A | 2/1998 | Anderson |
| 5,749,072 | A | 5/1998 | Mazurkiewicz et al. |
| 5,771,438 | A | 6/1998 | Palermo et al. |
| 5,802,167 | A | 9/1998 | Hong |
| 5,929,774 | A | 7/1999 | Charlton |
| 5,933,506 | A | 8/1999 | Aoki et al. |
| 5,949,896 | A | 9/1999 | Nageno et al. |
| 5,987,146 | A | 11/1999 | Pluvinage et al. |
| 6,021,207 | A | 2/2000 | Puthuff et al. |
| 6,054,989 | A | 4/2000 | Robertson et al. |
| 6,081,724 | A | 6/2000 | Wilson |
| 6,094,492 | A | 7/2000 | Boesen |
| 6,111,569 | A | 8/2000 | Brusky et al. |
| 6,112,103 | A | 8/2000 | Puthuff |
| 6,157,727 | A | 12/2000 | Rueda |
| 6,167,039 | A | 12/2000 | Karlsson et al. |
| 6,181,801 | B1 | 1/2001 | Puthuff et al. |
| 6,208,372 | B1 | 3/2001 | Barraclough |
| 6,275,789 | B1 | 8/2001 | Moser et al. |
| 6,339,754 | B1 | 1/2002 | Flanagan et al. |
| 6,408,081 | B1 | 6/2002 | Boesen |
| D464,039 | S | 10/2002 | Boesen |
| 6,470,893 | B1 | 10/2002 | Boesen |
| D468,299 | S | 1/2003 | Boesen |
| D468,300 | S | 1/2003 | Boesen |
| 6,542,721 | B2 | 4/2003 | Boesen |
| 6,560,468 | B1 | 5/2003 | Boesen |
| 6,654,721 | B2 | 11/2003 | Handelman |
| 6,664,713 | B2 | 12/2003 | Boesen |
| 6,694,180 | B1 | 2/2004 | Boesen |
| 6,718,043 | B1 | 4/2004 | Boesen |
| 6,738,485 | B1 | 5/2004 | Boesen |
| 6,748,095 | B1 | 6/2004 | Goss |
| 6,754,358 | B1 | 6/2004 | Boesen et al. |
| 6,784,873 | B1 | 8/2004 | Boesen et al. |
| 6,823,195 | B1 | 11/2004 | Boesen |
| 6,852,084 | B1 | 2/2005 | Boesen |
| 6,879,698 | B2 | 4/2005 | Boesen |
| 6,892,082 | B2 | 5/2005 | Boesen |
| 6,920,229 | B2 | 7/2005 | Boesen |
| 6,952,483 | B2 | 10/2005 | Boesen et al. |
| 6,987,986 | B2 | 1/2006 | Boesen |
| 7,136,282 | B1 | 11/2006 | Rebeske |
| 7,203,331 | B2 | 4/2007 | Boesen |
| 7,209,569 | B2 | 4/2007 | Boesen |
| 7,215,790 | B2 | 5/2007 | Boesen et al. |
| 7,463,902 | B2 | 12/2008 | Boesen |
| 7,508,411 | B2 | 3/2009 | Boesen |
| 7,983,628 | B2 | 7/2011 | Boesen |
| 8,140,357 | B1 | 3/2012 | Boesen |
| 2001/0005197 | A1 | 6/2001 | Mishra et al. |
| 2001/0027121 | A1 | 10/2001 | Boesen |
| 2001/0056350 | A1 | 12/2001 | Calderone et al. |
| 2002/0002413 | A1 | 1/2002 | Tokue |
| 2002/0007510 | A1 | 1/2002 | Mann |
| 2002/0010590 | A1 | 1/2002 | Lee |
| 2002/0030637 | A1 | 3/2002 | Mann |
| 2002/0046035 | A1 | 4/2002 | Kitahara et al. |
| 2002/0057810 | A1 | 5/2002 | Boesen |
| 2002/0076073 | A1 | 6/2002 | Taenzer et al. |
| 2002/0118852 | A1 | 8/2002 | Boesen |
| 2003/0065504 | A1 | 4/2003 | Kraemer et al. |
| 2003/0100331 | A1 | 5/2003 | Dress et al. |
| 2003/0104806 | A1 | 6/2003 | Ruef et al. |
| 2003/0115068 | A1 | 6/2003 | Boesen |
| 2003/0125096 | A1 | 7/2003 | Boesen |
| 2003/0218064 | A1 | 11/2003 | Conner et al. |
| 2004/0070564 | A1 | 4/2004 | Dawson et al. |
| 2004/0160511 | A1 | 8/2004 | Boesen |
| 2005/0043056 | A1 | 2/2005 | Boesen |
| 2005/0125320 | A1 | 6/2005 | Boesen |
| 2005/0148883 | A1 | 7/2005 | Boesen |
| 2005/0165663 | A1 | 7/2005 | Razumov |
| 2005/0196009 | A1 | 9/2005 | Boesen |
| 2005/0251455 | A1 | 11/2005 | Boesen |
| 2005/0266876 | A1 | 12/2005 | Boesen |
| 2006/0029246 | A1 | 2/2006 | Boesen |
| 2006/0074671 | A1 | 4/2006 | Farmaner et al. |
| 2006/0074808 | A1 | 4/2006 | Boesen |
| 2008/0195980 | A1* | 8/2008 | Morris ..... G06F 3/011 715/864 |
| 2008/0254780 | A1 | 10/2008 | Kuhl et al. |
| 2009/0017881 | A1 | 1/2009 | Madrigal |
| 2010/0320961 | A1 | 12/2010 | Castillo et al. |
| 2011/0137141 | A1* | 6/2011 | Razoumov ..... A61B 5/0002 600/316 |
| 2011/0286615 | A1 | 11/2011 | Olodort et al. |
| 2012/0130196 | A1* | 5/2012 | Jain ..... A61B 5/0022 600/300 |
| 2014/0270227 | A1 | 9/2014 | Swanson |
| 2015/0127129 | A1* | 5/2015 | Abuelsaad ..... G06T 13/205 700/94 |
| 2016/0324478 | A1* | 11/2016 | Goldstein ..... A61B 5/721 |

FOREIGN PATENT DOCUMENTS

| | | |
|---|---|---|
| GB | 2074817 | 4/1981 |
| JP | 06292195 | 10/1998 |
| WO | 2014043179 A2 | 3/2014 |
| WO | 2015110577 A1 | 7/2015 |
| WO | 2015110587 A1 | 7/2015 |

OTHER PUBLICATIONS

BRAGI Is On Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready To Rumble, A Lot To Be Done Over Christmas (Dec. 22, 2014).
BRAGI Update—Memories From April—Update On Progress (Sep. 16, 2014).
BRAGI Update—Memories from May—Update On Progress—Sweet (Oct. 13, 2014).
BRAGI Update—Memories From One Month Before Kickstarter—Update On Progress (Jul. 10, 2014).
BRAGI Update—Memories From The First Month of Kickstarter—Update on Progress (Aug. 1, 2014).
BRAGI Update—Memories From The Second Month of Kickstarter—Update On Progress (Aug. 22, 2014).
BRAGI Update—New People @BRAGI—Prototypes (Jun. 26, 2014).
BRAGI Update—Office Tour, Tour To China, Tour to CES (Dec. 11, 2014).
BRAGI Update—Status On Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back To China, Backer Day, On Track(May 16, 2015).
BRAGI Update—Beta2 Production and Factory Line(Aug. 20, 2015).

(56) References Cited

OTHER PUBLICATIONS

BRAGI Update—Certifications, Production, Ramping Up.
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2014).
BRAGI Update—On Track, Design Verification, How It Works and What's Next(Jul. 15, 2015).
BRAGI Update—On Track, On Track and Gems Overview.
BRAGI Update—Status On Wireless, Supply, Timeline and Open House@BRAGI(Apr. 1, 2015).
BRAGI Update—Unpacking Video, Reviews On Audio Perform and Boy Are We Getting Close(Sep. 10, 2015).
Last Push Before The Kickstarter Campaign Ends on Monday 4pm CET (Mar. 28, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for The Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).

* cited by examiner

NOTIFICATION AND ACTIVATION SYSTEM UTILIZING ONBOARD SENSORS OF WIRELESS EARPIECES

PRIORITY STATEMENT

This application claims priority to U.S. Provisional Patent Application 62/272,348, filed on Dec. 29, 2015, and entitled Notification And Activation System Utilizing Onboard Sensors of Wireless Earpieces, hereby incorporated by reference in its entirety.

BACKGROUND

I. Field of the Disclosure

The illustrative embodiments relate to wireless earpieces. More specifically, but not exclusively, the illustrative embodiments relate to implementing various electronic actions, processes, and device configurations in response to determining an emotional state of a user of wireless earpieces.

II. Description of the Art

The growth of wearable devices is increasing exponentially. This growth is fostered by the decreasing size of microprocessors, circuit boards, chips, and other components. In many cases, performing user specified tasks and requests is not difficult. Even with the advancements, the footprint available for the wearable devices may be very limited. As a result, designing and manufacturing the wearable device with sufficient sensors and other components to enhance operation may be challenging.

SUMMARY OF THE DISCLOSURE

One embodiment provides a system, method and one or more wireless earpieces for determining a status of a user. Sensor readings for the user are performed utilizing sensors of the one or more wireless earpieces. The sensor readings are analyzed. A status of the user is determined utilizing the sensor readings from the sensors of the one or more wireless earpieces. Another embodiment provides wireless earpieces including a processor and a memory storing a set of instructions. The set of instructions are executed to perform the method described.

Another embodiment provides a wireless earpiece. The wireless earpiece includes a frame for fitting in an ear of a user. The wireless earpiece further includes a logic engine controlling functionality of the wireless earpiece. The wireless earpiece further includes a number of sensors taking sensor readings. The logic engine analyzes the sensor readings and determines a status of the user utilizing the sensor readings from the sensors of the wireless earpieces. The status of the user may, for example, be a physical or emotional condition of the user.

BRIEF DESCRIPTION OF THE DRAWINGS

Illustrated embodiments of the present invention are described in detail below with reference to the attached drawing figures, which are incorporated by reference herein, and where.

DETAILED DESCRIPTION OF THE DISCLOSURE

Figure 1:
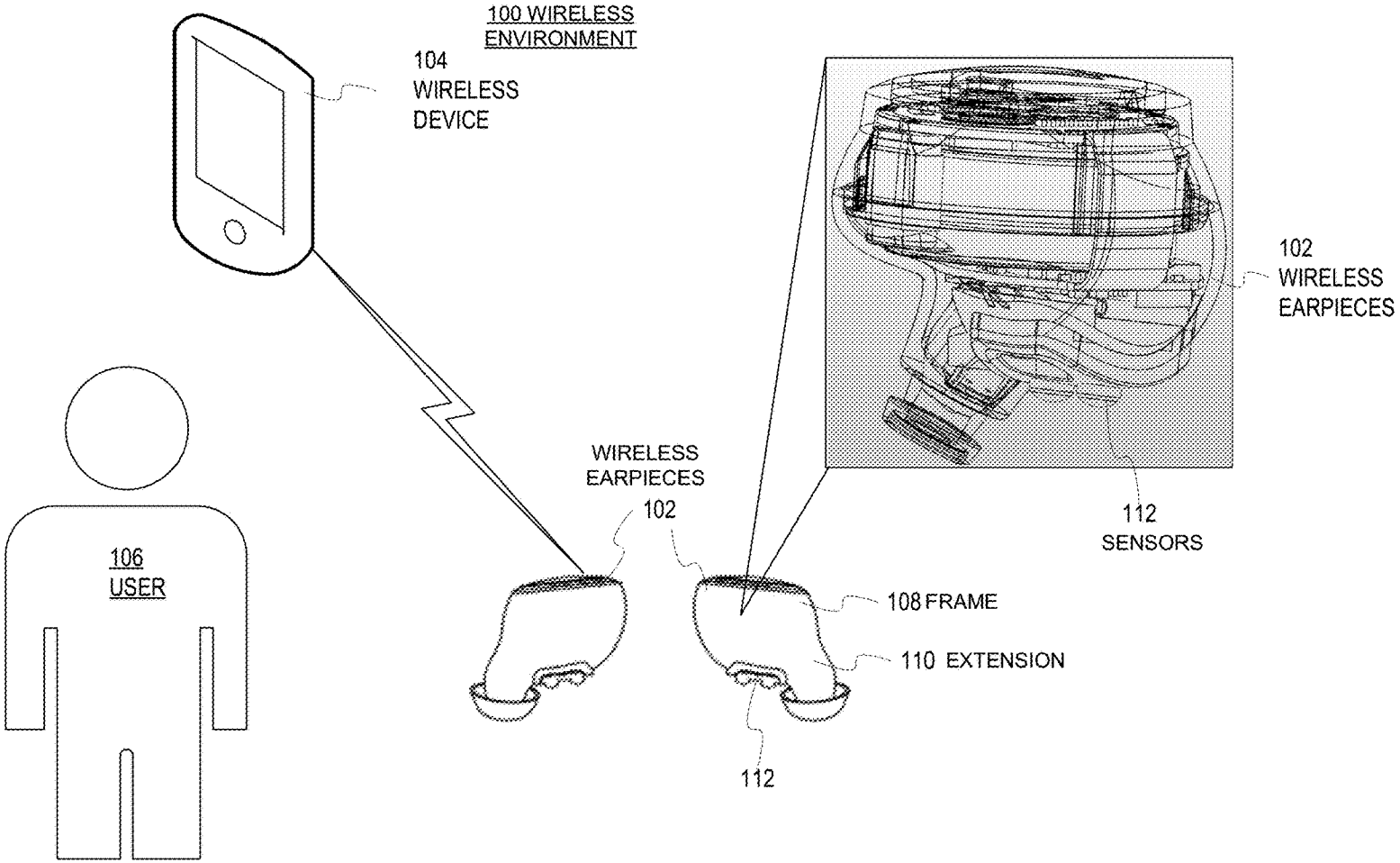
FIG. 1 is a pictorial representation of a communication system in accordance with an illustrative embodiment.

The illustrative embodiments provide a system, method, and a wireless earpiece for determining a status of a user of wireless earpieces. The status of the user may indicate the user's physical or emotional state as determined using biometric information, sensed information, and other data about the user or the user's environment. The status of the user may be determined from a pair of wireless earpieces or a single wireless earpiece worn by the user. The description included herein may refer to the wireless earpieces individual or collectively.

The wireless earpieces are configured to fit at least partially into an external auditory canal of the user. The ear canal is a rich space for obtaining biometric measurements about the user as well as stabilizing the wireless earpieces as they are worn. The wireless earpieces may be utilized during a number of rigorous physical activities that require stability. The shape and configuration of the wireless earpieces allow the wireless earpieces to be worn for long periods of time while gathering valuable information utilizing the sensors of the wireless earpieces. The wireless earpieces may include sensor for measuring pulse rate, blood oxygenation, microphone, position/orientation, location, temperature, altitude, cadence, calorie expenditure, and so forth.

The wireless earpieces may include any number of sensor arrays configured to capture information about the user. The large amount of data may be utilized to determine a status of the user including information, such as mood. The wireless earpieces may configure themselves to perform various functions as well as sending commands to any number of proximate devices to implement commands or specified actions. The wireless earpieces may learn over time in response to selections made utilizing the wireless earpieces or interconnected devices, such as a cell phone.

The illustrative embodiments allow the sensors of the wireless earpieces to assess the status (external and dynamic manifestations of a user's internal emotional state). The sensors may sense dynamic manifestations including movement patterns, fluidity, hesitations, volume of the voice, amplitude and frequency modulations (e.g., jitter, shimmer rates, etc.) temperature fluctuations, increases or decreases in heart rate, level of sweat production for comparison utilize logic of the wireless earpieces to generate one or more actions. The user's short term and long term status include trends and historical information may be utilized by the user, medical professionals, professional trainers, and other interested individuals.

For example, if the user is becoming agitated, the wireless earpieces may play soothing music or open their favorite game on a connected wireless device. In response to determining the user is becoming tired or sluggish (e.g., pulse rate, head orientation slightly down, blood oxygenation, etc.) while driving, the user may play an audible alert to the user, play loud music, send commands to a vehicle system to automatically open a window of a vehicle or adjust the air conditioning, or communicate with other connected or proximate devices. Any number of actions or combinations of actions may be coordinated by the wireless earpieces to best meet the needs of the user.

FIG. 1 is a pictorial representation Iola wireless environment 100 in accordance with an illustrative embodiment. The wireless earpieces 102 may be configured to communicate with each other and with one or more wireless devices, such as a wireless device 104. The wireless earpieces 102 may be worn by a user 106 and are shown separately from their positioning within the ears of the user 106 for purposes of visualization. A block diagram of the wireless earpieces 102 if further shown in FIG. 2 to further illustrate components and operation of the wireless earpieces 102.

In one embodiment, the wireless earpieces 102 includes a frame 108 shaped to fit substantially within the ears of the user 106. The frame 108 is a support structure that at least partially encloses and houses the electronic components of the wireless earpieces 102, The frame 108 may be composed of a single structure or multiple structures that are interconnected. The frame 108 defines an extension 110 configured to fit substantially within the ear of the user 106. The extension 110 may be removable covered by one or more sleeves. The sleeves may be changed to fit the size and shape of the user's ears. The sleeves may come in various sizes and have extremely tight tolerances to fit the user 106 and one or more other users that may utilize the wireless earpieces 102 during their expected lifecycle. In another embodiment, the sleeves may be custom built to support the interference fit utilized by the wireless earpieces 102 while also being comfortable while worn. In one embodiment, the frame 108 or the extension 110 (or other portions of the wireless earpieces 102) may include sensors 112 for sensing pulse, blood oxygenation, temperature, glucose levels, impacts, activity level, position, location, orientation, as well as any number of internal or external user biometrics. In other embodiments, the sensors 112 may be internally positioned within the wireless earpieces 102. For example, the sensors 112 may represent metallic contacts, optical interfaces, or micro-delivery systems for receiving and delivering information. Small electrical charges may be passed through the sensors 112 to analyze the biometrics of the user 106 including pulse, blood analysis, sweat levels, band so forth. Sensors 112 may also be utilized to provide a small electrical current which may be useful for alerting the user, stimulating blood flow, alleviating nausea, or so forth.

In some applications, temporary adhesives or securing mechanisms (e.g., clamps, straps, extenders, etc.) may be utilized to ensure that the wireless earpieces 102 remain in the ears of the user 106 even during the most rigorous and physical activities. For example, the wireless earpieces 102 may be utilized during marathons, swimming, team sports, biking, hiking, parachuting, or so forth. The wireless earpieces 102 may be configured to play music or audio, receive and make phone calls or other communications, determine ambient environmental conditions (e.g., temperature, altitude, location, speed, heading, etc.), read user biometrics (e.g., heart rate, motion, temperature, sleep, blood oxygenation, voice output, calories burned, forces experienced, etc.), and receive user input, feedback, or instructions. In some embodiments, the wireless earpieces 102 may be utilized to specifically monitor the condition of the user 106. For example, the wireless earpieces 102 may be worn by special needs individuals to determine biometric information indicative of a physical or emotional condition before it may become apparent to a caregiver or guardian, such as when the user 106 is becoming agitated, scared, angry, or sad.

The wireless earpieces 102 may determine their position with respect to each other as well as the wireless device 104. For example, position information for the wireless earpieces 102 and the wireless device 104 may determine proximity of the devices in the wireless environment 100. For example, global positioning information or signal strength/activity may be utilized to determine proximity and distance of the devices to each other in the wireless environment 100. In one embodiment, the distance information may be utilized to determine devices available to receive communications from the wireless earpieces, such as the status of the user 106.

In one embodiment, the wireless earpieces 102 and the corresponding sensors 112 (whether internal or external) may be configured to take a number of measurements or log information during normal usage. The sensor measurements may be utilized to extrapolate other measurements, factors, or conditions applicable to the user 106. The user 106 or another party may configure the wireless earpieces 102 directly or through a connected device and app (e.g., mobile app with a graphical user interface) to store or share information, audio, images, and other data. Some examples of standard usage may include detecting and recording a heartbeat, active participation in a conversation, listening to music, or so forth.

In one embodiment, the wireless earpieces 102 may learn to extrapolate the status of a user based on historical information or secondary verification. For example, the user 106 may utilize a user interface presented by the wireless device 104 to measure information, such as the user's temperature, pulse rate, blood oxygenation, glucose levels, or so forth so that the wireless earpieces 102 may determine the likely condition and physical and emotional status of the user 106. The user 106 or another party may also utilize the wireless device 104 to associate biometric information and conditions with the actual or perceived status of the user 106. As a result, the wireless earpieces 102 may be adjusted or trained over time to become even more accurate in determining the status of the user 106. The wireless earpieces 102 may utilize historical information to generate thresholds, policies, or settings for determining when and how the user's status is determined by the wireless earpieces 102 and how that data may be shared with the user 106 or the wireless device 104 to take any number of actions.

The wireless earpieces 102 may include any number of sensors 112 and logic for measuring and determining user biometrics, such as pulse rate, blood oxygenation, temperature, calories expended, voice and audio output, position, and orientation (e.g., body, head, etc.). The sensors 112 may also determine the user's location, position, velocity, impact levels, and so forth. The sensors 112 may also receive user input and convert the user input into commands or selections made across the personal devices of the personal area network. For example, the user input detected by the wireless earpieces 102 may include voice commands, head motions, finger taps, finger swipes, motions or gestures, or other user inputs sensed by the wireless earpieces. The user input may be determined by the wireless earpieces 102 and converted into commands that may be sent one or more external devices, such as the wireless device 104, a tablet computer, or so forth.

The sensors 112 may make all of the measurements about the user 106 or may communicate with any number of other sensory devices in the wireless environment 100 to measure information and data about the user 106 as well as the wireless environment 100 itself. In one embodiment, the wireless environment 100 may represent all or a portion of a personal area network. The wireless earpieces 102 may be utilized to control, communicate, manage, or interact with a number of other wearable devices or electronics, such as smart glasses, helmets, smart glass, watches or wrist bands, other wireless earpieces, chest straps, implants, displays, clothing, or so forth. A personal area network is a network for data transmissions among devices, such as personal computing, communications, camera, vehicles, entertainment, and medical devices. The personal area network may utilize any number of wired, wireless, or hybrid configurations and may be stationary or dynamic. For example, the personal area network may utilize wireless network protocols or standards, such as INSTEON, IrDA, Wireless USB, Bluetooth, Z-Wave, ZigBee, Wi-Fi, ANT+ or other applicable radio frequency signals. In one embodiment, the personal area network may move with the user 106.

In other embodiments, the wireless environment 100 may include any number of devices, components, or so forth that may communicate with each other directly or indirectly through a wireless (or wired) connection, signal, or link. The wireless environment 100 may include one or more networks and network components and devices (not shown), such as routers, servers, signal extenders, intelligent network devices, computing devices, or so forth. In one embodiment, the network of the wireless environment 100 represents a personal area network as previously disclosed.

Communications within the wireless environment 100 may occur through the network or may occur directly between devices, such as the wireless earpieces 102 and the wireless device 104, or indirectly through a network, such as a Wi-Fi network. In one embodiment, the wireless environment 100 may communicate with or include a wireless network, such as a Wi-Fi, cellular (e.g., 3G, 4G, 5G, PCS, GSM, etc.), Bluetooth, or other short range or long range radio frequency network. The wireless environment 100 may also communicate with any number of hard wired networks, such as local area networks, coaxial networks, fiber-optic networks, network adapters, or so forth. Communications within the wireless environment 100 may be operated by one or more users, service providers, or network providers.

The wireless earpieces 102 may play, communicate, or utilize any number of alerts or communications to indicate that the status of the user 106. In one embodiment, the status information may be determined utilizing measurements made by the sensors 112 as well as data extrapolated from the sensor measurements. For example, an alert may be played audibly to the user 106 indicating "your blood pressure is extremely elevated, you need to sit down and relax" based on the sensor data that is applicable to the user (e.g., temperature, pulse rate, blood pressure, voice characteristics, etc.). The wireless earpieces 102 may also play an alert indicating that the user 106 is extremely tired. Warnings of tiredness may be played to the wireless device 104, a vehicle system, a friend, family member or other user, or other user, system, or device that may be able to support the user 106 in the activity being performed. The corresponding action taken by the wireless earpieces 102 to correct the status or measurements may also be communicated to the user 106 and the wireless device 104.

In other embodiments, the wireless earpieces 102 may also vibrate, flash, play a tone or other sound, or give other indications of the user's status (or that the user 106 may be in distress) in order to take corrective actions or implement any number of processes. The wireless earpieces 102 may also communicate an alert to the wireless device 104 that shows up as a notification, message, or other indicator indicating the changed status of the user 106 and well as the sensed and/or extrapolated sensor measurements.

The wireless earpieces 102 as well as the wireless device 104 may include logic for automatically implementing corrective actions in response to various conditions and factors of the wireless environment 100. For example, the wireless device 104 may communicate instructions received from the wireless earpieces 102 for the user 106 to relax, perform a breathing or activity exercise, play a game, perform a number of steps, or take other actions. The wireless device 104 may include an application that displays instructions and information to the user 106 in response to the status of the user and actions associated with the user's status.

In one embodiment, the wireless device 104 may utilize short-range or long-range wireless communications to communicate with the wireless earpieces 102 through a wireless signal or devices of the wireless environment 100. For example, the wireless device 104 may include a Bluetooth and cellular transceiver within the embedded logical components. For example, the wireless signal may be a Bluetooth, Wi-Fi, Zigbee, Ant+, or other short range wireless communication.

The wireless device 104 may represent any number of wireless or wired electronic communications or computing devices, such as smart phones, laptops, desktop computers, control systems, tablets, displays, gaming devices, music players, personal digital assistants, vehicle systems, or so forth. The wireless device 104 may communicate utilizing any number of wireless connections, standards, or protocols (e.g., near field communications, Bluetooth, Wi-Fi, wireless Ethernet, etc.), For example, the wireless device 104 may be a touch screen cellular phone that communicates with the wireless earpieces 102 utilizing Bluetooth communications. The wireless device 104 may implement and utilize any number of operating systems, kernels, instructions, or applications that may make use of the available sensor data sent from the wireless earpieces 102. For example, the wireless device 104 may represent any number of android, iOS, Windows, open platforms, or other systems and devices. Similarly, the wireless device 104 or the wireless earpieces 102 may execute any number of applications that utilize the user input, proximity data, biometric data, and other feedback from the wireless earpieces 102 to determine the user status, tune, adjust, or bias sensor measurements, share applicable information and data, control the applications, play audible or tactile alerts, or make other selections.

As noted, the layout of the internal components of the wireless earpieces 102 and the limited space available for a product of limited size may affect where the sensors 112 may be positioned. The positions of the sensors 112 within each of the wireless earpieces 102 may vary based on the model, version, and iteration of the wireless earpiece design and manufacturing process. As a result, sensor measurements may be made as well as extrapolated to ensure proper operation and functionality of the wireless earpieces 102 to enhance and improve the user's status.

Figure 2:
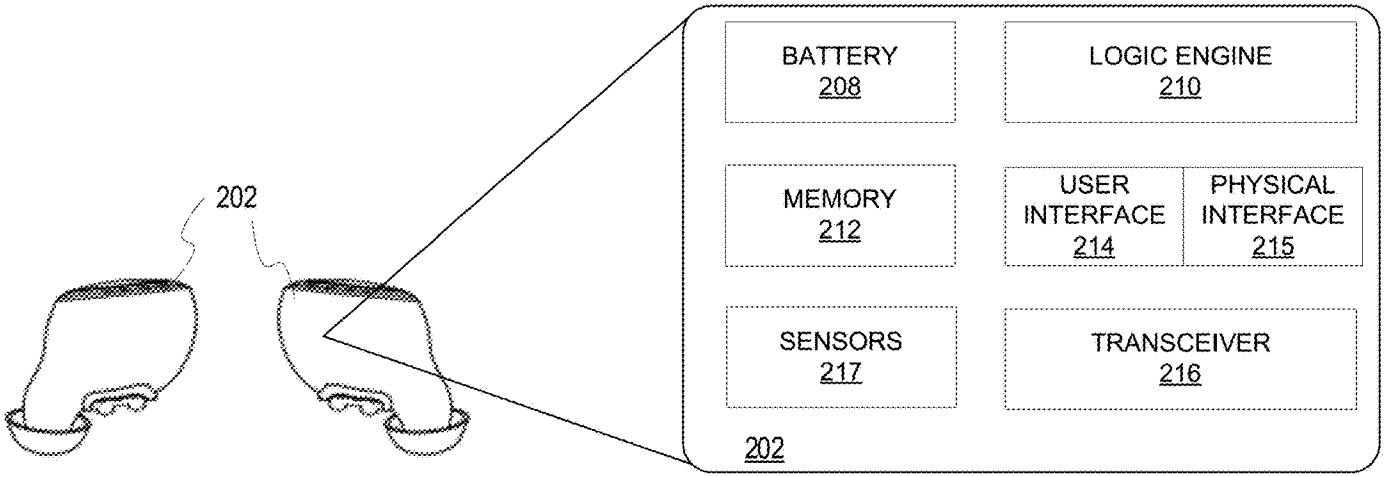
FIG. 2 is a block diagram of wireless earpieces in accordance with an illustrative embodiment.

FIG. 2 further illustrates a block diagram of the wireless earpieces 202. As noted, the components of the wireless earpieces 202 may be described collectively rather than individually. The wireless earpieces 202 may be wirelessly linked to any number of wireless devices, such as the wireless device 104 of FIG. 1. For example, wireless devices may include wearable devices, communications devices, computers, entertainment devices, vehicle systems, exercise equipment, or so forth. Sensor measurements, user input, and commands may be received from either the wireless earpieces 202 or the wireless device (not shown) for processing and implementation on either of the devices (or other externally connected devices). Reference to the wireless earpieces 202 may descriptively or functionally refer to either the pair of wireless earpieces (wireless earpieces) or individual wireless earpieces (tell wireless earpiece and right wireless earpiece) without limitation.

In some embodiments, the wireless device may act as a logging tool for sensor data or measurements made by the wireless earpieces 202. For example, the wireless device may receive and share data captured by the wireless earpieces 202 in real-time including a status of the user. As a result, the wireless device may be utilized to store, display, and synchronize sensor data received from the wireless earpieces 202. For example, the wireless device may display user pulse rate, temperature, proximity, location, blood oxygenation, distance, calories burned, and so forth as measured by the wireless earpieces 202. The wireless device may be configured to receive and display alerts that indicate conditions to share information about the user's status have been met. For example, if the wireless earpieces 202 meet a distance threshold with a wireless device, the wireless earpieces 202 may automatically share pre-selected sensor data to the wireless device for display as an alert, message, or in-app communication, such as "your pulse is racing and your blood sugar is low, you should consider eating something and resting." The wireless earpieces 202 and the wireless device may have any number of electrical configurations, shapes, and colors and may include various circuitry, connections, and other components utilized to perform the illustrative embodiments.

In one embodiment, the wireless earpieces 202 may include a battery 208, a logic engine 210, a memory 212, a user interface 214, a physical interface 215, a transceiver 216, and sensors 217. The wireless device may have any number of configurations and include components and features as are known in the art.

The battery 208 is a power storage device configured to power the wireless earpieces 202. In other embodiments, the battery 208 may represent a fuel cell, thermal electric generator, piezo electric charger, solar charger, ultra-capacitor, or other existing or developing power storage technologies. The sensors 217 may be utilized to measure the temperature of the battery 208 and the condition of internal components of the wireless earpieces. The sensors may also be utilized to determine data about external conditions and factors applicable to the user, the user's environment, a communicating wireless device, or so forth. Other conditions and factors sensed by the sensors 217 (e.g., water/humidity, pressure, blood oxygenation, blood content levels, altitude, position, impact, radiation, etc.) may also be determined with the data being processed by the logic engine 210.

The logic engine 210 is the logic that controls the operation and functionality of the wireless earpieces 202. The logic engine 210 may include circuitry, chips, and other digital logic. The logic engine 210 may also include programs, scripts, and instructions that may be implemented to operate the logic engine 210. The logic engine 210 may represent hardware, software, firmware, or any combination thereof. In one embodiment, the logic engine 210 may include one or more processors. The logic engine 210 may also represent an application specific integrated circuit (ASIC) or field programmable gate array (FPGA). The logic engine 210 may utilize sensor measurements, user input, user preferences and settings, conditions, factors, and environmental conditions to determine the status of the user, at least in part, from measurements performed by the wireless earpieces 202. The wireless earpieces 202 may function separately or together to determine the status of the user and actions that may be taken based on the status of the user. For example, processing may be divided between the wireless earpieces 202 to increase the speed of processing and to load balance any processes being performed.

In one embodiment, the logic engine 210 may perform the status determinations based on measurements and data from the sensors 217. The logic engine 210 may also perform any number of mathematical functions (e.g., linear extrapolation, polynomial extrapolation, conic extrapolation, French curve extrapolation, polynomial interpretation) to infer the status and condition of the user from the sensor measurements. The logic engine 210 may utilize time and other sensor measurements as causal forces to enhance a mathematical function utilized to perform the determinations, processing, and extrapolation performed by the logic engine 210.

The logic engine 210 may also process user input to determine commands implemented by the wireless earpieces 202 or sent to the wireless earpieces 202 through the transceiver 216. Specific corrective actions may be associated with sensor measurements, extrapolated measurements, environmental conditions, proximity thresholds, and so forth. For example, the logic engine 210 may implement a macro allowing the user to share data and specify the status of the user associated with sensor readings when the wireless earpieces are proximate the wireless device 204.

In one embodiment, a processor included in the logic engine 210 is circuitry or logic enabled to control execution of a set of instructions. The processor may be one or more microprocessors, digital signal processors, application-specific integrated circuits (ASIC), central processing units, or other devices suitable for controlling an electronic device including one or more hardware and software elements, executing software, instructions, programs, and applications, converting and processing signals and information, and performing other related tasks.

The memory 212 is a hardware element, device, or recording media configured to store data or instructions for subsequent retrieval or access at a later time. The memory 212 may represent static or dynamic memory. The memory 212 may include a hard disk, random access memory, cache, removable media drive, mass storage, or configuration suitable as storage for data, instructions, and information. In one embodiment, the memory 212 and the logic engine 210 may be integrated. The memory may use any type of volatile or non-volatile storage techniques and mediums. The memory 212 may store information related to the status of a user, wireless earpieces 202, wireless device 204, and other peripherals, such as a wireless device, smart glasses, smart watch, smart case for the wireless earpieces 202, wearable device, and so forth. In one embodiment, the memory 212 may display or communicate instructions, programs, drivers, or an operating system fir controlling the user interface 214 including one or more LEDs or other light emitting components, speakers, tactile generators (e.g., vibrator), and so forth. The memory 212 may also store sensor measurements, an extrapolation processes, extrapolation data, bias levels, thresholds, conditions, signal or processing activity, historical information, proximity data, and so forth.

The transceiver 216 is a component comprising both a transmitter and receiver which may be combined and share common circuitry on a single housing. The transceiver 216 may communicate utilizing Bluetooth, Wi-Fi, ZigBee, Ant+, near field communications, wireless USB, infrared, mobile body area networks, ultra-wideband communications, cellular (e.g., 3G, 4G, 5G, PCS, GSM, etc.), infrared, or other suitable radio frequency standards, networks, protocols, or communications. The transceiver 216 may also be a hybrid transceiver that supports a number of different communications. For example, the transceiver 216 may communicate with wireless devices or other systems utilizing wired interfaces (e.g., wires, traces, etc.), NFC or Bluetooth communications. The transceiver 216 may also detect amplitudes and infer distance between the wireless earpieces 202 and external devices, such as the wireless device or a smart case of the wireless earpieces 202.

The components of the wireless earpieces 202 may be electrically connected utilizing any number of wires, contact points, leads, busses, wireless interfaces, or so forth. In addition, the wireless earpieces 202 may include any number of computing and communications components, devices or elements which may include busses, motherboards, circuits, chips, sensors, ports, interfaces, cards, converters, adapters, connections, transceivers, displays, antennas, and other similar components. The physical interface 215 is hardware interface of the wireless earpieces 202 for connecting and communicating with wireless devices or other electrical components, devices, or systems.

The physical interface 215 may include any number of pins, arms, or connectors for electrically interfacing with the contacts or other interface components of external devices or other charging or synchronization devices. For example, the physical interface 215 may be a micro USB port. In one embodiment, the physical interface 215 is a magnetic interface that automatically couples to contacts or an interface of a wireless device. In another embodiment, the physical interface 215 may include a wireless inductor for charging the wireless earpieces 202 without a physical connection to a charging device.

The user interface 214 is a hardware interface for receiving commands, instructions, or input through the touch (haptics) of the user, voice commands, or predefined motions. For example, the user interface 214 may include a touch screen, one or more cameras or image sensors, microphones, speakers, and so forth. The user interface 214 may be utilized to control the other functions of the wireless earpieces 202. The user interface 214 may include the LED array, one or more touch sensitive buttons or portions, a miniature screen or display, or other input/output components. The user interface 214 may be controlled by the user or based on commands received from the wireless device or a linked wireless device. For example, the user may turn on, reactivate, or provide feedback utilizing the user interface 214.

In one embodiment, the user may provide feedback by tapping the user interface 214 once, twice, three times, or any number of times. Similarly, a swiping motion may be utilized across or in front of the user interface 214 (e.g., the exterior surface of the wireless earpieces 202) to implement a predefined action. Swiping motions in any number of directions or gestures may be associated with specific activities, such as share exercise data, share music playlist, share vitals, play music, pause, fast forward, rewind, activate a digital assistant (e.g., Siri, Cortana, smart assistant, etc.), or so forth without limitation The swiping motions may also be utilized to control actions and functionality of wireless devices or other external devices (e.g., smart television, camera array, smart watch, etc.). The user may also provide user input by moving his head in a particular direction or motion or based on the user's position or location. For example, the user may utilize voice commands, head gestures, or touch commands to change the content displayed by a wireless device. The user interface 214 may also provide a software interface including any number of icons, soft buttons, windows, links, graphical display elements, and so forth.

In one embodiment, the user interface 214 may periodically utilize one or more microphones and speakers of the wireless earpieces to ask the user to indicate his or her status. The associated sensor readings may then be associated with the user's status as received through the user interface 214.

The sensors 217 may include pulse oximeters, accelerometers, gyroscopes, magnetometers, water, moisture, or humidity detectors, impact/force detectors, thermometers, inertial sensors, photo detectors, miniature cameras, microphones, and other similar instruments for detecting the user's status as well as location, utilization of the wireless earpieces 202, orientation, motion, and so forth. The sensors 217 may also be utilized to determine the biometric, activity, location, and speed measurements of the user. In one embodiment, the sensors 217 may store data that may be shared with other components (e.g., logic engine 210 performing extrapolation for a remote location), users, and devices.

Externally connected wireless devices may include components similar in structure and functionality to those shown for the wireless earpieces 202. For example, a wireless device may include any number of processors, batteries, memories, busses, motherboards, chips, transceivers, peripherals, sensors, displays, cards, ports, adapters, interconnects, and so forth. In one embodiment, the wireless device may include one or more processors and memories for storing instructions. The instructions may be executed as part of an operating system, application, browser, or so forth to implement the features herein described. For example, the user may set preferences for the wireless earpieces 202 to utilize sensor measurements to determine the status of the user. For example, the user may prevent the wireless earpieces 202 from determining the condition of the user at specified times. Likewise, the preferences may manage the actions taken by the wireless earpieces in response to the determined user status. In one embodiment, the wireless earpieces 202 may be magnetically or physically coupled to the wireless device to be recharged or synchronized.

The wireless device may also execute an application with settings or conditions for updating, synchronizing, sharing, saving, processing and utilizing status determinations and extrapolation. The user may adjust and program the settings including specified users, thresholds, activities, conditions, environmental factors, and so forth.

In another embodiment, the wireless device may also include sensors for detecting the location, orientation, and proximity of the wireless earpieces 202 to the wireless device. The wireless earpieces 202 may turn off sharing to the wireless device in response to losing a status or heart beat connection to preserve battery life and my only periodically search for a connection, link, or signal to the wireless device.

As originally packaged, the wireless earpieces 202 and the wireless device may include peripheral devices such as charging cords, power adapters, inductive charging adapters, solar cells, batteries, lanyards, additional light arrays, speakers, smart case covers, transceivers (e.g., Wi-Fi, cellular, etc.), or so forth. In one embodiment, the wireless earpieces 202 may include a smart case (not shown). The smart case may include an interface for charging the wireless earpieces 202 from an internal battery or through a wall connection to the smart case. The smart case may also utilize the interface or a wireless transceiver to log utilization, biometric information of the user, and other information and data. The smart case may also be utilized to perform the status determinations, extrapolation, sharing, and calibration features, operations, and methods herein described.

The illustrative embodiments provide a system, method and devices for processing sensor measurements to determine a status of the users. The sensors 217 may include temperature sensors, blood analysis sensors (e.g., blood oxygenation, glucose levels, component breakdown, etc.), humidity and water sensors, impact sensors, radiation detectors, pulse oximeters, accelerometers, gyroscopes, altitude sensors, GPS chips, and so forth. The sensors 217 may also be utilized to sense any number of biometric readings or information, such as heart rate, brain activity levels (e.g., EKG), respiratory rate, blood toxicity, skin physiology, or other biometric data.

The sensors 217 may be stand-alone measurement devices or may be integrated in one OF more chips, motherboards, cards, circuits, or so forth. The wireless earpieces 202 may communicate with other wearables (e.g., smart watch, ring, jewelry, smart wearables, etc.) to modify, filter, or otherwise optimize the accuracy of the sensor measurements.

In one embodiment, one of the sensors 217 experiencing a high level of noise or distortion may be ignored or disregarded while utilizing the measurements from a different sensor. For example, one of the sensors 217 that may have failed may be ignored in response to improper or unreliable data being gathered. As a result, the status determination process may be dynamically performed utilizing any combination of sensor measurements. For example, the number and position of the sensors 217 utilized to perform status determinations for the user may vary based on failures, inaccurate data, or other temporary or permanent issues with hardware and software of the wireless earpieces 202.

Figure 3:
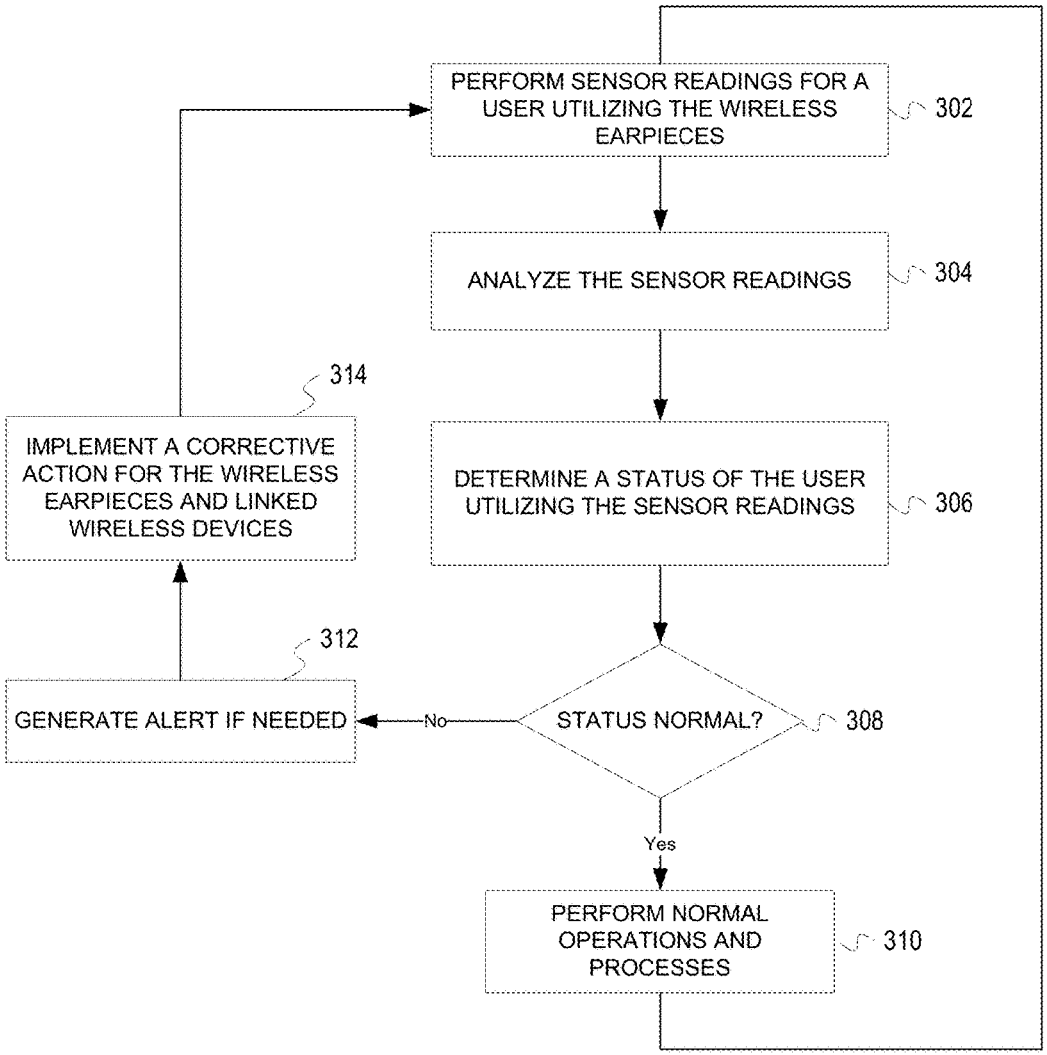
FIG. 3 is a flowchart of a process for determining a status of a user in accordance with an illustrative embodiment.

FIG. 3 is a flowchart of a process for determining a status of a user in accordance with an illustrative embodiment. In one embodiment, the process of FIG. 3 may be implemented by one or more wireless earpieces, such as the wireless earpieces 102 of FIG. 1. For example, the method of FIG. 3 may be performed for both of the wireless earpieces as a pair or for each of wireless earpieces individually to determine the status, condition, mood, or biometric readings of the user. In one embodiment, the system status may include pulse, voice amplitude, voice frequency, vocabulary, blood oxygenation, temperature, calories expended per time period, sweat levels, orientation, position, change in position, impacts experienced, and so forth. The method of FIG. 3 may be performed to determine whether the user feels normal or is experiencing different moods, needs, or experiences based on the user activity, environment, or so forth. In particular, the existing sensors of the wireless earpiece may be utilized to extrapolate or determine the short-term or long-term status of the user both physically and emotionally.

The process may begin with the wireless earpiece performing sensor readings for a user utilizing the wireless earpieces (step 302). The sensor locations and types for the wireless earpieces may vary. The sensors may generate a number of sensor readings that may be compiled to get a picture of the user's status. The sensors may include a temperature sensor, a pulse sensor, and a microphone (i.e., analyzing the user's voice). The sensors may measure data or information that may be utilized to determine or imply the user's status as herein described. The sensor may utilize any number of sampling rates or time periods for performing the sensor measurements. The sensor readings may also be performed in response to specified actions or events, such as impacts, sudden acceleration/deceleration, temperature drops, external alerts, loud noises, yelling sounds, or so forth. The changes may be saved, logged, or otherwise communicated to connected devices for utilization.

Next, the wireless earpieces, analyze the sensor measurements (step 304). The sensor measurements may be analyzed for accuracy statistical significance, and so forth. The sensor measurements may be particularly analyzed to determine whether changes in the sensor measurements is indicative of a change in the status of the user. In one embodiment, sensor measurements from the left wireless earpieces may be compared against those experienced by the right wireless earpiece to more accurately measure data. The wireless earpieces may also perform biasing or error correction as needed during step 304 to ensure the sensor measurements are accurate. For example, if a sensor from one of the wireless earpieces is experience incorrect or inaccurate data, the data from that sensor may be disregarded for purposes of performing analysis. The sensor measurements may be run through any number of computations utilizing the processor of the wireless earpiece.

Next, the wireless earpieces determine a status of the user utilizing the sensor readings (step 306). The status of the user may be determined by analyzing short-term and long term trends, averages, and data indicated by the sensor readings. The sensor readings may be utilized to definitively or tentatively determine the user's physical and emotional condition. In one embodiment, the sensor readings may be compared against a number of thresholds to determine the status of the user. For example, upper and lower thresholds for the different measurements may indicate the physical and emotional state of the user. The thresholds and changes in the sensor readings may be utilized to determine hourly, daily, weekly, and monthly trends for one or more user's that utilize the wireless earpieces.

In one embodiment, the wireless earpieces may ask the user based on certain conditions or circumstances to indicate the emotion being experienced at a given time. The wireless earpieces may note factors, sensor readings, and conditions and associate that information with the user's self-identified status (e.g., mood, health, desire, etc.). The user may be prompted audibly through the wireless earpieces or through one or more devices in communication with the wireless earpieces. For example, an application of a wireless device may display an application for receiving user input regarding the user's status as perceived by the user. As a result, historical information and previous accurate determinations may be utilized to precisely determine the status of the user.

Next, the wireless earpiece determines whether the status is normal (step 308). The user's status may be determined based on normal biometric information and conditions being experienced by the user. The normal status and sensor readings for the user may be determined utilizing preprogrammed information, such as pulse rate, voice amplitude and frequency, temperature, activity rate, and so forth. The user's biometrics may also be measured during a "normal state" to indicate the specific biometric readings.

If the status of the user is determined to be normal during step 308, the wireless earpiece performs normal operations and processes (steps 310). During step 310, the wireless earpiece may operate in the normal or default operating mode. The status of the user determined during step 306 may be utilized to determine whether the wireless earpiece should operate normally. The wireless earpieces may also send alerts or status updates to interconnected devices, systems, equipment, and components indicating the status of the user and indicating normal operation is appropriate.

If the status of the wireless earpiece is determined to not be normal during step 308, the wireless earpiece generates an alert if needed (step 312). The alert may be generated in any number of ways. In one embodiment, the alert is an internal alert that may be sent to the logic of the wireless earpiece in order to process the sensor readings. In another embodiment, the alert is communicated to the user as an audio, tactile, or visual alert, such as "Are you feeling okay?" The alert may also be communicated to a wireless device in communication with the wireless earpiece. For example, an alert may be sent to a cell phone in communication with the wireless earpiece to display an application specific alert to the user, such as "Your pulse rate is spiking." The alert may also prompt the user to indicate whether a corrective action should be implemented. For example, "Can I roll down the windows and call a friend for the last few minutes of your drive?" in response to a user's biometrics indicating the user is close to falling asleep while driving. In one embodiment, the wireless earpieces may store the sensor readings along with the associated status data for enhanced analysis over time.

Next, the wireless earpiece implements a correct action (step 314). The corrective action may be a default response to the user's status or may have been previously selected by the user, a guardian, employer, friend, family member, or forth. For example, in response to detecting the user is yelling and has an elevated pulse rate, the wireless earpieces may play soothing music and potentially request a linked wireless earpiece open a favorite movie or game. In another example, the wireless earpiece may implement cooling techniques in response to determining the user is overheating. The cooling techniques may include instructing devices or equipment in the user's environment to activate fans or air conditioning. The wireless earpieces may send commands, instructions, or feedback directly or through a network to any number of interconnected devices, systems, components, or equipment. The wireless earpiece may then return again to step 302 to perform sensor readings. As a result, the wireless earpieces may constantly utilize sensor readings to determine the user's status, conditions, and other information and data that may be utilized to implement corrective actions that better help and support the user by enhancing the operation of the wireless earpieces for the user.

During step 314, the corrective actions may be performed as long as the status of the user is determined to not be normal (e.g., outside various thresholds, parameters, or levels). The corrective actions may also be adjusted if they do not significantly affect the status of the user. For example, various different corrective actions or combinations of corrective actions may be implemented.

The process of FIG. 3 may allow the wireless earpieces to utilize logic to determine the status of the user. As a result, the wireless earpieces may implement any number of actions to enhance the user's status or condition.

The illustrative embodiments provide a system, method, wireless earpiece(s) for determine a status of a user for enhancing the operation and functionality of the wireless earpieces based on the status of the user. The illustrative embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computing system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Computer program code for carrying out operations of the embodiments may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN), a personal area network (PAN), or a wide area network (WAN), or the connection may be made to an external computer (e.g., through the Internet using an Internet Service Provider).

Figure 4:
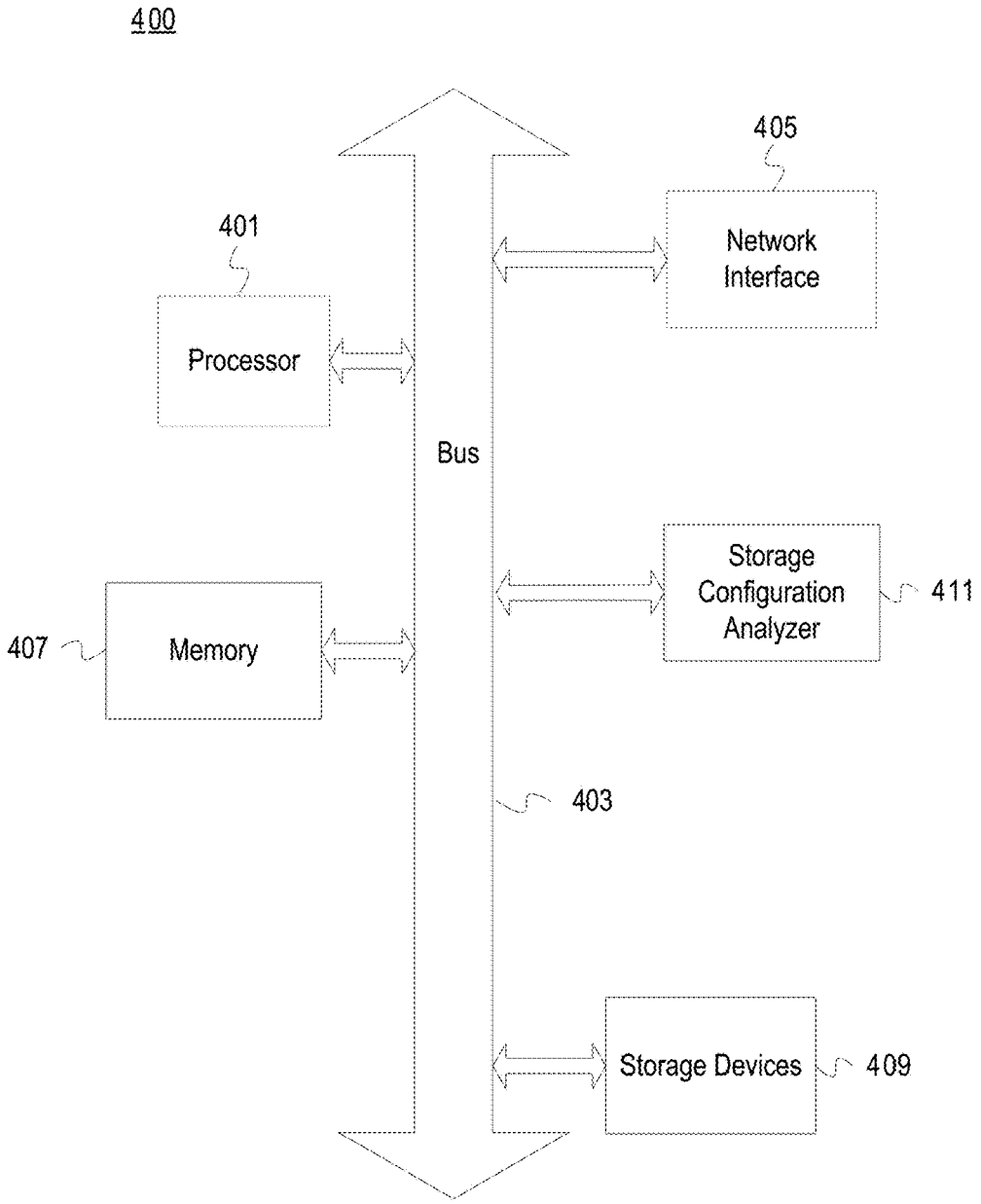
FIG. 4 depicts a computing system in accordance with an illustrative embodiment.

FIG. 4 depicts a computing system 400 in accordance with an illustrative embodiment. For example, the computing system 400 may represent a device, such as the wireless device 104 of FIG. 1. The computing device 400 may be utilized to receive user settings, instructions, or feedback for controlling the power management features of the wireless earpieces together and separately. The computing system 400 includes a processor unit 401 (possibly including multiple processors, multiple cores, multiple nodes, and/or implementing multi-threading, etc,). The computing system includes memory 407. The memory 407 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computing system also includes a bus 403 (e.g., PCI, ISA, PCI-Express, HyperTransport®, infiniBand®, NuBus, etc.), a network interface 405 (e.g., an ATM interface, an Ethernet interface, a Frame Relay interface, SONET interface, wireless interface, etc.), and a storage device(s) 409 (e.g., optical storage, magnetic storage, etc.). The system memory 407 embodies functionality to implement embodiments described above. The system memory 407 may include one or more functionalities that facilitate retrieval of the audio information associated with an identifier. Code may be implemented in any of the other devices of the computing system 400. Any one of these, functionalities may be partially (or entirely) implemented in hardware and/or on the processing unit 401. For example, the functionality may be implemented with an application specific integrated circuit, in logic implemented in the processing unit 401, in a co-processor on a peripheral device or card, etc. Further, realizations may include fewer or additional components not illustrated in FIG. 4 (e.g., video cards, audio cards, additional network interfaces, peripheral devices, etc.). The processor unit 401, the storage device(s) 409, and the network interface 405 are coupled to the bus 403. Although illustrated as being coupled to the bus 403, the memory 407 may be coupled to the processor unit 401.

The illustrative embodiments are not to be limited to the particular embodiments described herein. In particular, the illustrative embodiments contemplate numerous variations in the type of ways in which embodiments may be applied. For example, the wireless earpieces may be of various types including ear buds, behind-the-ear earpieces, headsets, or other types of ear pieces. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. A method for determining a status indicative of at least one of an emotional condition of a user and a mood of the user utilizing one or more wireless earpieces worn by the user, the method comprising:

performing sensor readings of the user utilizing sensors of the one or more wireless earpieces, wherein the sensor readings include audio of the user detected by at least one microphone of the one or more wireless earpieces and wherein the sensor readings include pulse of the user detected by at least one of the pulse sensors of the one or more wireless earpieces;

analyzing, with a processor within the one or more wireless earpieces, the sensor readings for accuracy by comparing the sensor readings from a left wireless earpiece of the one or more wireless earpieces against the sensor readings from a right wireless earpiece of the one or more wireless earpieces;

periodically asking the user, using one or more speakers of the one or more wireless earpieces, to indicate the status of the user;

receiving a response, at the at least one microphone of the one or more wireless earpieces, from the user regarding the status of the user;

associating the sensor reading with the status, by the processor of the one or more wireless earpieces, to determine the at least one emotional condition of the user and the mood of the user;

performing additional sensor readings for the user utilizing the sensors of the one or more wireless earpieces;

analyzing the additional sensor readings using the process of the one or more wireless earpieces to determine the at least one emotional condition of the user and the mood of the user; and implementing a corrective action for the user based on the emotional condition and/or the mood of the user wherein the corrective action comprises generating audio at the one or more speakers.

2. The method of claim 1, wherein the processor is further configured to determine whether the sensor readings are within one or more thresholds.

3. The method of claim 2, wherein the one or more thresholds indicate whether the status of the user is normal.

4. The method of claim 1, further comprising:

performing the sensor readings utilizing a plurality of sensors of the one or more wireless earpieces, wherein the one or more wireless earpieces are a pair of wireless earpieces.

5. The method of claim 1, wherein the sensors of the one or more wireless earpieces includes at least one temperature sensor.

6. The method of claim 1, further comprising:

associating one or more sensor readings with the status of the user in response to user input.

7. The method of claim 1, wherein the corrective action includes at least playing music.

8. The method of claim 1, wherein the corrective action includes providing audio instructions to the user.

9. The method of claim 1, wherein the sensor readings include biometric data about the user to determine if the data is indicative of the at least one emotional condition and/or mood.

10. The method of claim 1, wherein the status indicates short-term and long-term emotional trends of the user.

11. A wireless earpiece for determining a status indicative of at least one of an emotional condition of a user and a mood of the user, the earpiece comprising:

a frame for fitting in an ear of the user;

a processor controlling functionality of the wireless earpiece;

at least one microphone operatively connected to the processor;

at least one speaker operatively connected to the processor;

a plurality of sensors taking sensor readings, wherein the sensor reading include audio of the user detected by the at least one microphone of the one or more wireless earpieces and wherein the sensor readings include pulse of the user detected by at least one of the pulse sensors of the one or more wireless earpieces;

wherein the processor analyzes the sensor readings for accuracy and performs biasing and/or error correction as needed to ensure the sensor readings are accurate;

wherein the wireless earpiece is configured to periodically ask the user using the at least one microphone to indicate the status of the user, wherein the earpiece is further configured to:

receive a response from the user at the at the at least one microphone;

associate the sensor readings with the status of the user by the processor of the one or more wireless earpieces;

perform additional sensor readings utilizing the plurality of sensors;

wherein the processor analyzes the additional sensor readings to determine the emotional condition of the user and/or the mood of the user; and wherein the processor further determines whether the sensor readings are within one or more thresholds to determine the status of the user and implement a corrective action for the user based on the emotional condition and/or the mood of the user wherein the corrective action comprises generating audio at one or more speakers of the wireless earpieces.

12. The wireless earpiece of claim 11, wherein the processor is further configured to determine whether the sensor readings are within one or more thresholds.

13. The wireless earpiece of claim 12, wherein the one or more thresholds indicate whether the status of the user is normal.

14. The wireless earpiece of claim 11, further comprising: performing the sensor readings utilizing a plurality of sensors of the one or more wireless earpieces, wherein the one or more wireless earpieces are a pair of wireless earpieces.

15. The wireless earpiece of claim 11, wherein the sensors of the one or more wireless earpieces includes at least one temperature sensor.

16. The wireless earpiece of claim 11, further comprising: associating one or more additional sensor readings with a status of the user in response to user input.

17. The wireless earpiece of claim 11, wherein the corrective action includes at least playing music.

18. The wireless earpiece of claim 11, wherein the corrective action includes providing audio instructions to the user.

19. The wireless earpiece of claim 11, wherein the sensor readings include biometric data about the user to determine if the data is indicative of the at least one emotional condition and/or mood.

20. The wireless earpiece of claim 11, wherein the status indicates short-term and long-term emotional trends of the user.

* * * * *